United States Patent [19]

Theriault

[11] Patent Number: 4,672,828

[45] Date of Patent: Jun. 16, 1987

[54] KEY-IN-KNOB CYLINDER REPLACEMENT SYSTEM

[75] Inventor: Kenneth T. Theriault, Cheshire, Conn.

[73] Assignee: Lori Corporation, Southington, Conn.

[21] Appl. No.: 570,220

[22] Filed: Jan. 12, 1984

[51] Int. Cl.[4] ..... E05B 9/04

[52] U.S. Cl. ..... 70/373; 70/380; 70/448; 70/451

[58] Field of Search ..... 70/372–374, 70/375, 379 R, 380, 358, 448, 449, 451, 461

[56] References Cited

U.S. PATENT DOCUMENTS

| | | | |
|---|---|---|---|
| 1,565,558 | 12/1925 | Fremon | 70/375 |
| 2,877,638 | 3/1959 | Muttart | 70/373 X |
| 3,928,991 | 12/1975 | Gaul et al. | 70/372 X |
| 4,148,201 | 4/1979 | Miyamae et al. | 70/358 |
| 4,193,277 | 3/1980 | Lo | 70/358 |
| 4,369,642 | 1/1983 | Grell | 70/380 X |
| 4,470,278 | 9/1984 | Hale et al. | 70/380 X |
| 4,472,953 | 9/1984 | Gater | 70/373 |

FOREIGN PATENT DOCUMENTS

| | | | |
|---|---|---|---|
| 655095 | 7/1963 | Italy | 70/371 |

*Primary Examiner*—Robert L. Wolfe
*Assistant Examiner*—Lloyd A. Gall
*Attorney, Agent, or Firm*—Chilton, Alix & Van Kirk

[57] ABSTRACT

A key-in-knob type cylinder replacement system comprises a replacement cylinder having a generally cylindrical shell and a plug having a keyway and housing pin means to prevent the rotation of the plug. A false bible dimensioned to be generally commensurate in size and shape to the projecting pin housing of the cylinder to be replaced is mounted to the cylinder shell. An adaptor means for actuating the latch assembly in response to rotation of the replacement plug is secured to the replacement cylinder plug by means of a clip. A replacement kit provides a plurality of false bibles and adaptor means, each of which is adapted to be mounted to the plug of the plug-shell combination to form a replacement for a conventional key-in-knob cylinder.

18 Claims, 6 Drawing Figures

KEY-IN-KNOB CYLINDER REPLACEMENT SYSTEM

BACKGROUND OF THE INVENTION

This invention relates to key-in-knob locks. More specifically, this invention relates to a system for assembling replacement cylinders for key-in-knob locks.

Prior art conventional key-in-knob cylinders generally comprise a cylinder shell having a rotatable cylinder plug including a keyway. A pin housing or bible, also often refered to as the block or pin housing, of any of a variety of shapes and dimensions projects radially from the cylinder shell. The bible houses the top pins and springs which, together with the bottom pins in the plug, prevent rotation of the key plug relative to the shell without a proper key. Such conventional key-in-knob lock cylinders further include an actuator of any of a variety of shapes and dimensions to transfer rotational motion from the cylinder plug into movement of a latching mechanism inside the lockset. Lock technology has advanced to a level wherein cylinders which are highly pick resistant have been provided in such compact forms that the provision of the radially projecting bible to house top pins and springs is no longer required. Exemplary of the new and improved compact pick resistant locks wherein the locking mechanism is completely housed within the cylindrical body are the locks of U.S. Pat. No. 4,404,824 and of copending application Ser. No. 510,613 filed July 5, 1983 entitled "Side Bar Lock With Enhanced Pick Resistance", now U.S. Pat. No. 4,524,593 and assigned to the assignee of the present invention.

Because of the wide popularity which as been enjoyed by conventional key-in-knob locks, large numbers of the key-in-knob cylinders would be upgraded in the interest of enhanced security if such upgrading could be economically achieved. However, inventory costs for stocking complete cylinders with their many bible and actuator configurations are quite high. The present invention is a new and improved system for assembling replacement high-security key-in-knob cylinders which may be substituted for prior art cylinders which include a shell, plug, bible, and actuator.

BRIEF SUMMARY OF THE INVENTION

Briefly stated, the invention in a preferred form is a replacement system providing a replacement lock assembly for a conventional key-in-knob lock of a type including a generally cylindrical body, a plug having a keyway and rotatable relative to said body upon insertion of a proper key into the keyway, a bible projecting from said body and housing top pins and springs to prevent rotation of the plug, and an actuation means for actuating a latch assembly in response to rotation of the plug. The replacement cylinder assembly of the invention comprises a replacement cylinder having a generally cylindrical shell which houses a plug, the plug having a keyway and being rotatable relative to the shell upon insertion of a proper key into the keyway. The plug houses means which engage the shell to normally prevent the rotation of the plug. A false bible is dimensioned to be generally commensurate in size and shape to the bible of the cylinder to be replaced. A bible mounting means secures the false bible to the cylinder body. An adaptor means for actuating the latch assembly of the lock to be replaced in response to rotation of the replacement cylinder plug is secured to the plug by means of an adaptor retainer.

The diameter of the replacement cylinder body is generally commensurate with the diameter of the cylindrical body of the key-in-knob lock to be replaced. The adaptor is preferably a sleeve-like member including a pair of diametrically opposed, i.e., aligned, openings and a peripheral groove. The plug of the replacement lock preferably includes a transverse bore so that the adaptor may be secured to the plug by means of a clip which is received in the bore and the aligned openings of the adaptor member. The adaptor may also have outer slot means for receiving a tailpiece which is further secured by means of a lock ring.

A replacement lock kit in accordance with the present invention typically will be provided with a plurality of false bibles each of which is dimensioned to be generally commensurate in size and shape with a bible of a different selected conventional key-in-knob cylinder. The kit also includes a plurality of adaptor means each of which is adapted for actuating an associated latch assembly of a selected key-in-knob lock in response to rotation of the replacement plug. A method for replacing a conventional key-in-knob cylinder using the present invention comprises providing a replacement lock kit, selecting a false bible and mounting the selected bible to the cylindrical body of the replacement cylinder, selecting an adaptor means, and mounting the adaptor means to the plug of the replacement cylinder. The method may also include mounting a tailpiece to the adaptor means and replacing the conventional cylinder with the assembled replacement cylinder.

An object of the invention is to provide a new and improved key-in-knob cylinder replacement system which provides for assembly of a replacement cylinder which is suitable for replacing one of a multiplicity of conventional key-in-knob type cylinders.

Another object of the invention is to provide a new and improved cylinder replacement system wherein replacement cylinders may be assembled for a multiplicity of different conventional locks to be rekeyed, which replacement locks employ a single basic lock cylinder.

Another object of the invention is to provide a new and improved cylinder replacement system wherein a multiplicity of different replacement cylinders may be constructed without the requirement of a large inventory of assembled replacement cylinders for each of the conventional cylinders to be replaced.

A further object of the invention is to provide a new and improved cylinder replacement system which provides for the efficient and inexpensive assembling of replacement locks for a wide variety of conventional key-in-knob type cylinders.

Other objects and advantages of the invention will become apparent from the accompanying drawings and detailed description.

DETAILED DESCRIPTION

Figure 1:
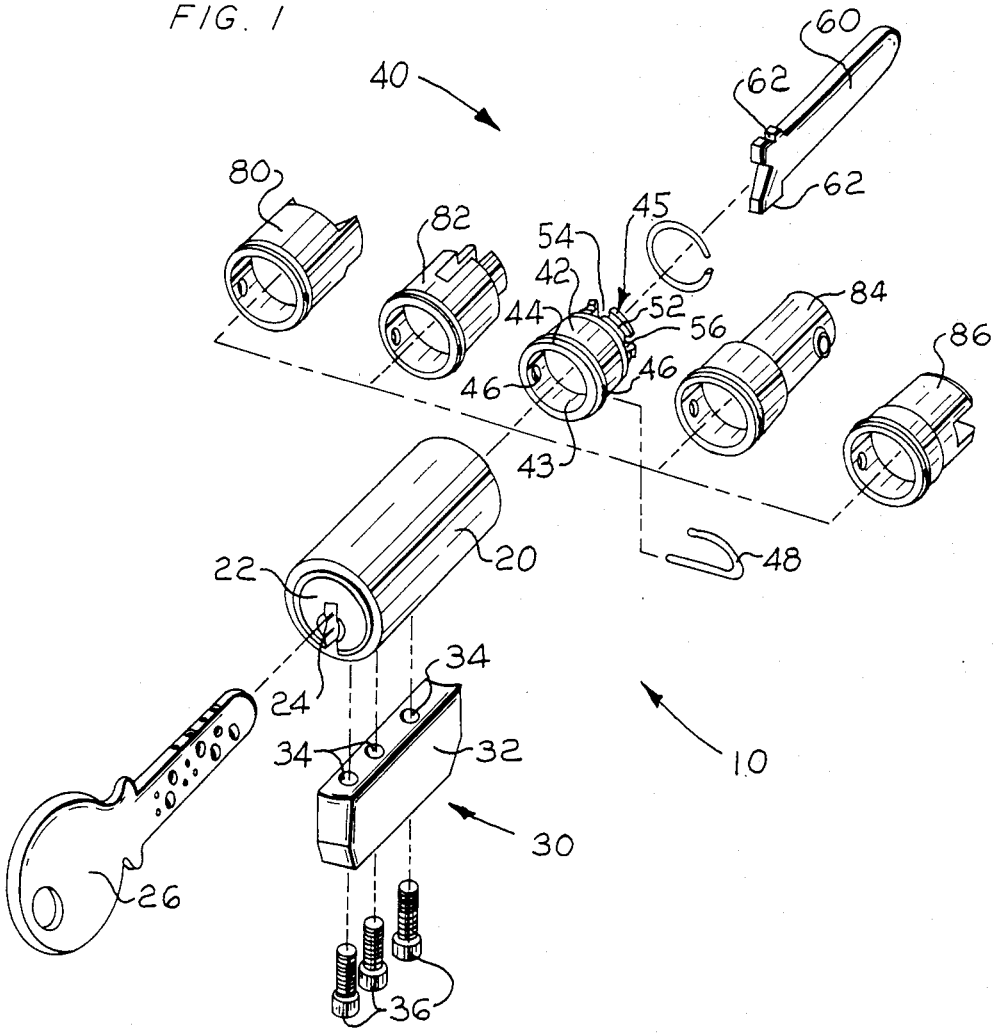
FIG. 1 is an exploded perspective view illustrating a replacement cylinder system in accordance with the present invention including a plurality of interchangeable components thereof.

With reference to the drawings, wherein like numerals represent like parts throughout the several Figures, a replacement lock system in accordance with the preferred embodiment of the present invention is generally designated by the numeral 10. Replacement lock system 10 provides means whereby a multiplicity of differently configured replacement locks may be assembled, each replacement lock being adapted for replacing a corresponding specific key-in-knob type cylinder. The assembled replacement cylinders of the present invention provide suitable replacement cylinders for a multiplicity of common key-in-knob type locks as well as a large number of tubular type locks. With reference to FIG. 1, the replacement system employs a basic cylinder body 20 which mounts a false bible subassembly denoted generally by the numeral 30 and an adaptor subassembly denoted generally by the numeral 40. Cylinder body 20 is preferably of a compact cylindrical form and houses a rotatable cylinder plug 22, the entire locking mechanism being essentially contained within the cylinder body. In preferred form, the locking mechanism 20, 22 is of an efficient, compact, pick-resistant form such as disclosed in U.S. Pat. No. 4,524,593 entitled "Side Bar Lock With Enhanced Pick Resistance" and assigned to the assignee of the present invention. Relevant portions of U.S. Pat. No. 4,524,593 are incorporated herein by reference. Other compact locks are also suitable for use in the practice of the invention.

Figure 2:
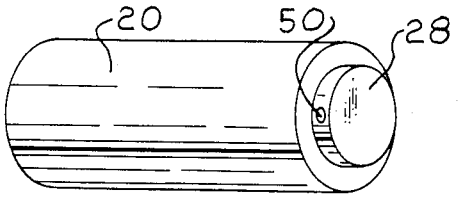
FIG. 2 is an enlarged perspective view of the cylinder body of the replacement cylinder system of FIG. 1 illustrated from the rear of FIG. 1.
Figure 3:
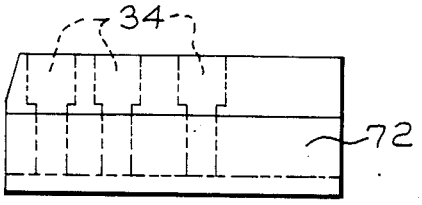
FIG. 3 is a side view, partially in phantom, illustrating an interchangeable false bible for the replacement cylinder system of FIG. 1.
Figure 4:
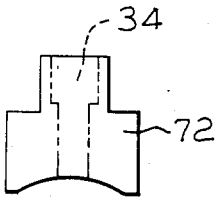
FIG. 4 is a front view of the false bible of FIG. 3, partially illustrated in phantom.

Cylinder plug 22 includes a keyway 24 for receiving a key 26. Upon reception of the correct key 26 in keyway 24, the locking mechanism allows for rotation of the plug relative to the cylinder shell 20. A stud 28, FIG. 2, which is either integral with key plug 22 or rigidly coupled to key plug 22 projects rearwardly from the cylinder body 20. Stud 28 is provided with a means for connecting with an adaptor means. The adaptor means is an intermediate coupling means, i.e., a connecting mechanism, which generally functions to actuate an existing installed latch assembly such as, for example, to latch or unlatch a door, in response to rotation of the key plug.

False bible subassembly 30 comprises a false bible 32 which is dimensioned and shaped to resemble the bible, i.e., the pin housing or block, of a key-in-knob cylinder to be replaced. Bible 32 may be a solid metallic member having a generally trapezoidal shape and including a plurality of bores 34 for receiving bible screws 36. Bible 32 may thus be mounted to cylinder body 20 by tightening screws 36 into longitudinally aligned threaded openings (not shown) provided in the cylinder body. It will be appreciated that, unlike the bible of the lock which is to be replaced, the bible 32 of replacement lock system 10 does not house nor provide any locking mechanisms, but merely generally functions to duplicate the exterior size and shape of the bible portion of the cylinder to be replaced and prevent the cylinder body from rotation within its receptacle.

Figure 5:
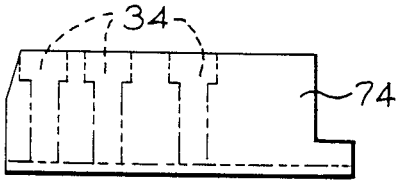
FIG. 5 is a side view of a third interchangeable false bible for the replacement cylinder system of FIG. 1, partially illustrated in phantom.
Figure 6:
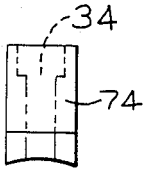
FIG. 6 is a front view of the false bible of FIG. 5, partially illustrated in phantom.

With further reference to FIG. 3 through FIG. 6, false bible 32 may be selected from an assortment of various false bibles, each such bible corresponding in size and shape to a bible portion of a common cylinder. False bible 72 illustrated in FIG. 3 and FIG. 4 and false bible 74 illustrated in FIG. 5 and FIG. 6 are exemplary of the wide variety of size and shape of bibles which may be provided and selected so that a replacement cylinder may be assembled to sufficiently exteriorly resemble any of a number of key-in-knob type cylinders to be replaced.

With reference to FIG. 1, adaptor subassembly 40 comprises, for purposes of illustration, an adaptor 42 which is selected from an assortment of adaptors, other adaptors of the assortment being designated by the numerals 80, 82, 84, and 86. The adaptors provide mechanical linkage from the stud 28 of the cylinder plug 22 to the existing installed latch assembly i.e., the adapter assemblies will substitute for the actuating means of the lock being rekeyed. The adaptors essentially function, sometimes via a further mechanical coupling member, to actuate the latch assembly in response to rotation of the cylinder plug. It will be appreciated that in general the locks of different manufacturers and individual models of a given manufacturer may have slightly different cylinder configurations. Therefore, a specific and perhaps a unique adaptor may be required for each lock model in order that an existing cylinder may be replaced with a suitable replacement cylinder in accordance with the invention.

Adaptor 42 is a sleeve-like member adapted at a forward portion 43 to interiorly receive stud 28. Adaptor 42 further includes at the forward portion a circular peripheral groove 44. Each adaptor is also provided, at the base of groove 44, with a pair of aligned apertures 46. A resilient retainer clip 48 may be employed to secure adaptor 42 to stud 28. Clip 48 includes a linear portion and an arcuate portion. Stud 28 preferably is provided with a diametral bore 50. Upon alignment of apertures 46 and bore 50, the linear portion of clip 48 is inserted through apertures 46 and bore 50 to lock adaptor 42 to cylinder body 20. The resilient arcuate portion of clip 48 is then snapped into groove 44.

The rear portion of adaptor 42, indicated generally at 45, will generally be of reduced diameter relative to front portion 43. Adaptor 42 includes at the rear a segmented circumferential groove 52 and opposing pairs of radial slots 54 and 56. A blade-like tailpiece 60 having a pair of oppositely oriented tapered slots 62 at its forward end is receivable in slots 54 or slots 56 of adaptor 42 so that slots 62 align with groove 52. Upon insertion of the tailpiece, slots 62 and groove 52 are complementary so that a split retainer ring may be snapped into the aligned groove 52 and slots 62 to secure the tailpiece 60 to adaptor 42. It should be appreciated that a wide assortment of tailpieces 60 of varying shapes and sizes may be provided depending upon the specific lock to be replaced.

Many key-in-knob cylinders do not require an element such as tailpiece 60. A replacement cylinder for such locks thus requires only a specifically selected adaptor to provide means for rotatably coupling the replacement cylinder plug to the existing installed latch assembly.

As shown in FIG. 1, in place of the foregoing adaptor/tailpiece subassembly as previously described in conjunction with adaptor 42, an adaptor such as adaptor 80, adaptor 82, adaptor 84, or adaptor 86 may be mounted to the cylinder body in a manner similar to that previously described for adaptor 42. Each of adaptors 80, 82, 84, and 86 includes a forward portion similar to forward portion 43. The rear portions of the latter adaptors are configured for engagement with installed latch assemblies associated with the cylinders to be replaced. It will be apparent to those skilled in the art that each of adaptors 80, 82, 84, and 86 is specifically configured in combination with the lock cylinder 20 and bible subassembly 30 to replace a common well-known key-in-knob cylinder.

In accordance with the invention, a replacement cylinder kit which requires a relatively few parts may be employed for assembling a large number of cylinders which are suitable for replacing a number of common makes and models of key-in-knob cylinders. Such a replacement kit need employ only a single lock assembly, an assortment of false bibles, an assortment of adaptors, an assortment of tailpieces, and means for connecting the foregoing components to the cylinder body such as, for example, screws, reainer clips, and retainer rings. A suitable replacement cylinder may be constructed by selecting a false bible in accordance with the bible portion of the cylinder to be replaced, selecting an adaptor in accordance with the cylinder to be replaced, and if necessary selecting a tailpiece in accordance with the cylinder to be replaced. The false bible may then be bolted to the cylinder body and the adaptor may be easily secured to the stud 28 by means of the retainer clip 48. If necessary, a tailpiece may be selected in accordance with the cylinder to be replaced and secured at the end of the adaptor by means of suitable insertion of a retainer ring. The cylinder to be replaced may then be removed and replaced with the assembled replacement cylinder as previously described. Generally, the existing installed latch assembly need not be replaced.

It will be appreciated that the above-described replacement system allows replacement of a wide variety of key-in-knob type cylinders without the requirement that each of the complete cylinders be maintained in inventory. Moreover, the replacement lock system provides an efficient system for providing replacement cylinders even when the original cylinder has been discontinued by the manufacturer and/or are not possible to obtain.

While a preferred embodiment of the invention has been set forth for purposes of illustration, the foregoing description should not be deemed a limitation of the present invention. Accordingly, various adaptations, alternatives, and modifications to the foregoing invention may occur to one skilled in the art without departing from the spirit and scope of the present invention.

What is claimed is:

1. A replacement assembly for a lock cylinder of the type including a generally cylindrical body and a plug having a keyway, the plug being rotatable relative to said body upon insertion of the proper key into the keyway, the lock cylinder also including a pin housing projecting from the cylindrical body and means located within and partly extending from the pin housing for preventing rotation of the plug relative to the cylindrical body, the lock cylinder further including an actuation means for actuating a latch assembly in response to relative rotation between the cylindrical body and the plug, said replacement assembly comprising:

a generally cylindrical shell, said shell having an outer diameter generally commensurate with the diameter of the cylindrical body of the cylinder to be replaced;

plug means defining a keyway, said plug means being rotatable relative to said shell upon insertion of the proper key into the keyway, said plug means housing the means which prevents rotation of said plug means in the absence of the proper key;

a removable false bible, said false bible having a size and a shape substantially equal respectively to the size and shape of the pin housing of the lock cylinder to be replaced;

mounting means for removably affixing said false bible to said shell; and adaptor means for actuating a latch assembly in response to rotation of said plug means relative to said shell, said adaptor means being secured to said plug means.

2. The replacement assembly of claim 1 wherein the adaptor means includes a sleeve-like member.

3. The replacement assembly of claim 2 wherein said sleeve-like member includes a first peripheral groove and a pair of aligned apertures positioned at the base of said first groove.

4. The replacement assembly of claim 3 wherein said plug means includes a transverse bore and said adaptor means further includes a retainer comprising a clip receivable in said bore and said aligned apertures of said sleeve-like member, said clip being resiliently retained in said sleeve-like member first peripheral groove.

5. The replacement assembly of claim 2 wherein said adaptor means further comprises a tailpiece, said sleeve-like member having outer slot means for receiving said tailpiece.

6. The replacement assembly of claim 5 wherein said tailpiece has at least a first slot therein and said sleeve-like member has a second peripheral groove, said tailpiece being secured to said member by means of a lock ring received in said slot and in said sleeve-like member second groove.

7. A replacement kit for use in rekeying a lock, the lock including a cylinder of a type having a generally cylindrical body, a plug forming a keyway and rotatable relative to said body upon insertion of the proper key into the keyway, a pin housing projecting from the cylinder body, means located within and in part extending from said pin housing for preventing relative rotation between the cylindrical body and the plug, a latch assembly, and a coupling means for connecting the plug to the latch assembly, said replacement kit comprising:

a replacement cylinder having a generally cylindrical shell and a plug defining a keyway and rotatable relative to said shell upon insertion of the proper key into the keyway, said plug housing the means which prevent the rotation of said plug in the absence of the proper key in the keyway;

a plurality of false bibles, each of said false bibles having a size and a shape commensurate to the size and the shape of the pin housing of a different cylinder lock;

mounting means for affixing any selected one of said false bibles to said shell of said replacement cylinder;

a plurality of adaptor means, each of said adaptor means being sized and configured to engage and actuate a different cylinder lock latch assembly; and means for securing an individual selected one of said adaptor means to the plug of said replacement cylinder.

8. The kit of claim 7 wherein said false bibles are generally solid elements having a plurality of bores for receiving mounting screws and wherein said mounting means comprise mounting screws adapted to be received completely within said bores.

9. The kit of claim 8 wherein the adaptor means securing means comprises a resilient clip.

10. The kit of claim 8 further comprising at least a first elongated blade-like tailpiece and means for mounting said tailpiece to an adaptor means.

11. A method for rekeying a lock, the lock including a cylinder of the type having a generally cylindrical body, a plug having a keyway and rotatable relative to said cylindrical body upon insertion of the proper key into the keyway, a pin housing projecting from said cylindrical body, means for preventing rotation of said plug located in and in part extending from the pin housing, and means for actuating a latch assembly in response to rotation of said plug assembly, said method comprising the sfteps of:

(a) providing the replacement kit of claim 9;

(b) selecting a false bible from the plurality of false bibles in the kit, the selected bible having a size and a shape which substantially match the size and the shape of the pin housing of the lock to be rekeyed;

(c) securing the selected false bible to the shell by means of the bible mounting means;

(d) selecting an adaptor means for the plurality of adaptor means in the kit, the selected adaptor means having a size and a configuration which substantially match the size and the configuration of the actuating means of the lock to be rekeyed;

(e) mounting the selected adaptor means to the plug of the replacement cylinder included in the kit; and (f) removing the lock cylinder to be replaced and inserting in its place the replacement assembly produced from the kit.

12. The method of claim 11 wherein the step of mounting the adaptor means includes inserting a clip through the plug and adaptor means to couple the plug to the adaptor means whereby rotation of the plug will cause rotation of the adaptor means.

13. The method of claim 11 wherein the step of mounting the adaptor means includes attaching a tailpiece to the adaptor means.

14. A replacement assembly for a lock cylinder of the type including a generally cylindrical body and a plug having a keyway, the plug being rotatable relative to said body upon insertion of the proper key into the keyway, the lock cylinder also including a pin housing projecting from the cylindrical body and means located within and partly extending from said pin housing for preventing rotation of the plug relative to the cylindrical body, the lock cylinder further including an actuation means for actuating a latch assembly in response to relative rotation between the cylindrical body and the plug, said replacement assembly comprising:

a generally cylindrical shell, said shell having an outer diameter generally commensurate with the diameter of the cylindrical body of the cylinder to be replaced;

plug means defining a keyway, said plug means being rotatable relative to said shell upon insertion of the proper key into the keyway, said plug means housing the means which prevents the rotation of said plug means in the absence of the proper key;

a false bible, said false bible having a generally solid trapezoidal shape with a plurality of bores extending therethrough, said false bible having a size and shape substantially equal respectively to the size and shape of the pin housing of the lock cylinder to be replaced;

a plurality of screws received in said bores of said false bible, said screws engaging said shell for affixing said false bible to said shell; and adaptor means for actuating a latch assembly in response to rotation of said plug means relative to said shell, said adaptor means being secured to said plug means.

15. The replacement assembly of claim 14 wherein the adaptor means includes a sleeve-like member.

16. The replacement assembly of claim 15 wherein said sleeve-like member includes a first peripheral groove and a pair of aligned apertures positioned at the base of said first groove.

17. The replacement assembly of claim 16 wherein said plug means includes a transverse bore and said adaptor means further includes a retainer comprising a clip receivable in said bore and said aligned apertures of said sleeve-like member, said clip being resiliently retained in said sleeve-like member first peripheral groove.

18. The replacement assembly of claim 17 wherein said adaptor means further comprises:

a tailpiece; and means for mounting said tailpiece to said sleeve-like member.

* * * * *